US011346538B1

(12) United States Patent
Chen

(10) Patent No.: US 11,346,538 B1
(45) Date of Patent: May 31, 2022

(54) LED LIGHTING MODULE WITH ELECTRICAL POWER AND DATA CONNECTIONS

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 17/321,797

(22) Filed: May 17, 2021

(51) Int. Cl.
*F21V 23/06* (2006.01)
*F21V 23/00* (2015.01)
*F21Y 115/10* (2016.01)

(52) U.S. Cl.
CPC ..... *F21V 23/06* (2013.01); *F21V 23/001* (2013.01); *F21Y 2115/10* (2016.08)

(58) Field of Classification Search
CPC ..... F21V 23/06; F21V 23/001; F21V 23/00; F21Y 2115/10; F21Y 2113/13; F21K 9/278; F21S 4/10
See application file for complete search history.

(56) References Cited

U.S. PATENT DOCUMENTS 6,924,973 B2 * 8/2005 Kim ..... F21K 9/00 361/728
7,165,863 B1 * 1/2007 Thomas ..... F21V 15/01 362/219
7,231,261 B2 * 6/2007 Berentroth ..... G05B 19/0426 700/7
7,868,903 B2 * 1/2011 Wendler ..... F21V 23/06 345/619
8,167,465 B2 * 5/2012 Cha ..... F21V 15/01 362/362
8,230,575 B2 * 7/2012 Veenstra ..... H05K 5/064 29/592.1

FOREIGN PATENT DOCUMENTS

EP 1965123 * 9/2008 ..... F21V 21/002

* cited by examiner

*Primary Examiner* — Peggy A Neils
(74) *Attorney, Agent, or Firm* — Stuart M. Goldstein

(57) ABSTRACT

An LED lighting module has a main body section on which LED lights are mounted and informational wiring data and electrical power wiring which extends through the module. The module has first and second cavities, each cavity having two prongs located therein, the two prongs in the first cavity being electrically connected to the electrical power wiring and the two prongs in the second cavity being connected to the informational data wiring. Female connection members having informational data and electrical power wiring are inserted into the two cavities and plugged into the prongs to provide informational data and establish electrical power into the module. Multiple LED modules can be connected in one system having a single electrical power source and a single informational data processor by attaching the female connectors between multiple LED modules.

9 Claims, 6 Drawing Sheets

LED LIGHTING MODULE WITH ELECTRICAL POWER AND DATA CONNECTIONS

FIELD OF THE INVENTION

The present invention relates to the supply, connection, and distribution of electrical power and informational data to and from LED lighting modules.

BACKGROUND OF THE INVENTION

LED modules are advantageously used in flexible, signage installations, especially those requiring linear, curved and corner designs. Such modules are found, for example, in LED string lighting, sign channel lettering fixtures, and in window displays. The modules provide their illumination from a supply of electricity via wiring and wire connections. Most individual signage units comprising multiple modules require separate, individual, electrical power sources and wiring with stripped wire ends and wire connector nuts. Installing these systems is often difficult and, at the very least, inconvenient and time consuming, especially for large projects. In addition, operating these separate systems is inefficient and uneconomical. There are currently very few effective lighted, LED module signage systems which provide the illumination benefits of LED and similar lighting systems, but still allow for quick and ready installation, connection, and maintenance, utilizing a single power source for economically providing electrical power to multiple LED lighting modules.

The input of informational data to lighted signage is also sometimes required to provide relevant operational instructions to the signage system. Towards this end, in addition to providing quick connections of electrical power to LED lighting modules from a single power source, such connections should be capable of transmitting data in a similar fashion in one simple, compact system.

SUMMARY OF THE INVENTION

It is thus the object of the present invention to provide LED lighting modules with electrical power and informational data distribution connections which can be quickly and easily connected and installed, and which effectively, efficiently, and economically operate to electrically power and transmit data to a multitude of individual modules which could make up a signage fixture system.

These and other objects are accomplished by the present invention, an LED lighting module having a main body section on which LED lights are mounted and informational wiring data and electrical power wiring which extends into, through, and out of the module. The module also has first and second cavities, each cavity having two conductive prongs located therein, the two prongs in the first cavity being electrically connected to the electrical power wiring and the two prongs in the second cavity being connected to the informational data wiring. Separate female connection members having informational data and electrical power wiring are configured to be inserted into the two cavities and plugged into the prongs in the cavities to provide informational data and establish electrical power into the module. Multiple LED modules can be connected in one system having a single electrical power source and a single informational data processor solely by attaching the female connectors between multiple LED modules.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
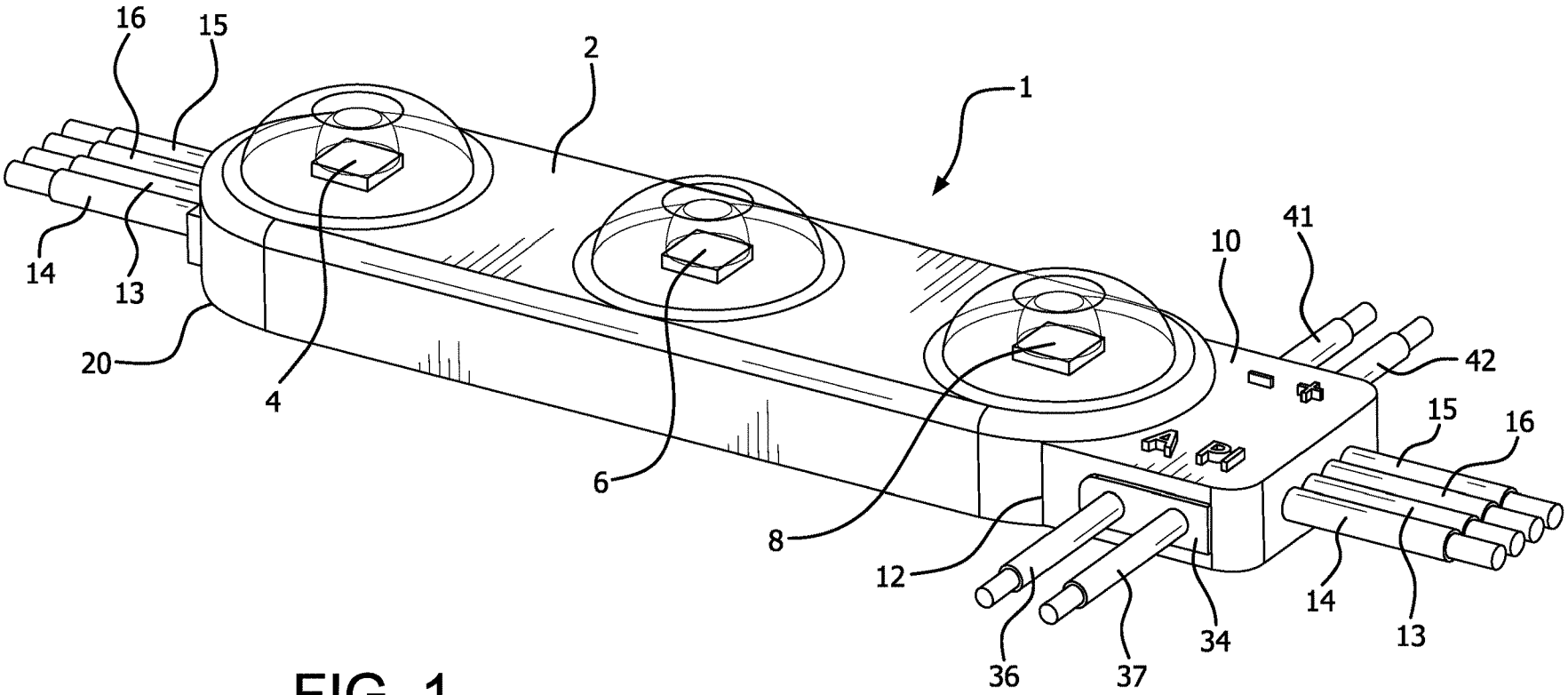
FIG. 1 is a perspective view of the LED lighting module of the present invention.
Figure 2:
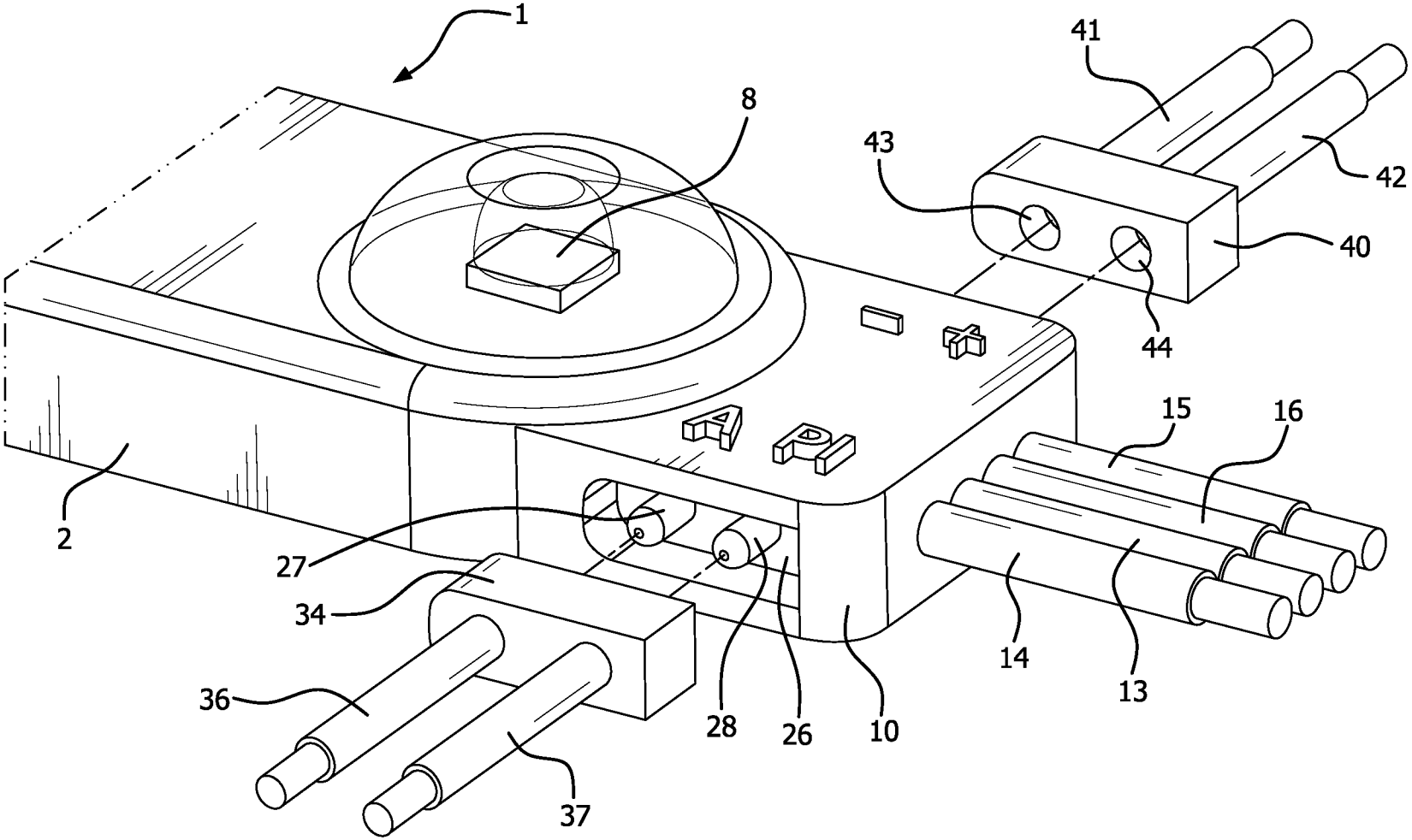
FIG. 2 is a partial end view of the LED lighting module of the present invention illustrating the positioning of female connectors prior to their insertion into a module cavity.

LED lighting module 1 comprises elongated main body section 2 on which LED lights 4, 6, and 8 are mounted. Module 1 also comprises connectivity section 10 attached to main body section 2 at one end 12 of the main body section. Informational data wiring 13 and 14 and electrical power wiring 15 and 16 extend to, through, and out module 1, i.e. connectivity section 10 and main body section 2. A connectivity section can optionally be attached at opposite end 20 of main body section 2, in which case informational data wiring 13 and 14 and electrical power wiring 15 and 16 extend through this second connectivity section as well.

Figure 3:
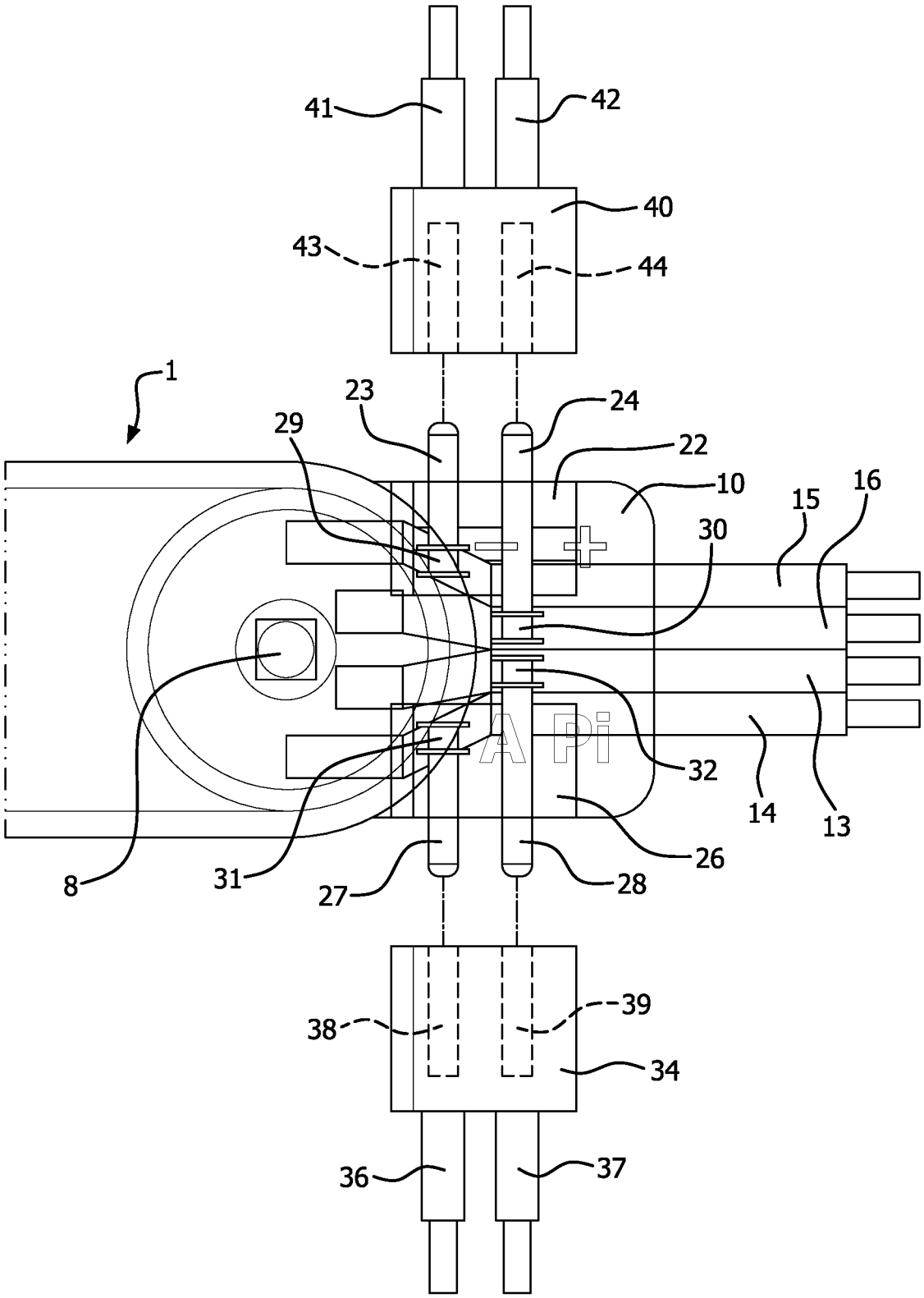
FIG. 3 is a partial, ghosted end view of the LED lighting module of the present invention.

Connectivity section 10 of module 1 comprises opposite facing internal cavities 22 and 26. Outwardly extending conductive prongs 23 and 24 and 27 and 28 are located within cavities 22 and 26 respectively. The inboard ends of the prongs have carpet pins or like attachment members 29, 30, 31, and 32 which are soldered or equivalently connected to wiring 13, 14, 15 and 16. As best seen in FIG. 3, prong 23 is connected to electrical power wiring 15 via carpet pin 29; prong 24 is connected to electrical power wiring 24 via carpet pin 30; prong 27 is connected to data wiring 14 via carpet pin 31; and prong 28 is connected to data wiring 13 via carpet pin 32. This wire connection provides informational data and electrical power to light and control LED lights 4, 6, and 8 of module 1 when female connectors 34 and 35 are connected to module 1. Input data wiring 36 and 37 extends from connector 34 to informational data processor 102. Slotted openings 38 and 39 within connector 34 are configured to accept prongs 27 and 28 when the connector is inserted into cavity 26 of connectivity section 10 of module 1; thus making the connection which provides informational data to the module from processor 102.

In like manner, electrical power wiring 41 and 42 extends from connector 40 to electrical power source 100. Slotted openings 43 and 44 within connector 40 are configured to accept prongs 23 and 24 when the connector is inserted into cavity 22 of connectivity section 10 of module 1; thus making the connection which provides electrical power to the module from electrical power source 100.

As described above, connectivity section 10 comprises cavities 22 and 26 for accepting connectors 34 and 40. However, it is contemplated that additional connector receiving cavities for both informational data and electrical power can be included in connectivity section 10 for the insertion of additional connectors.

Figure 4:
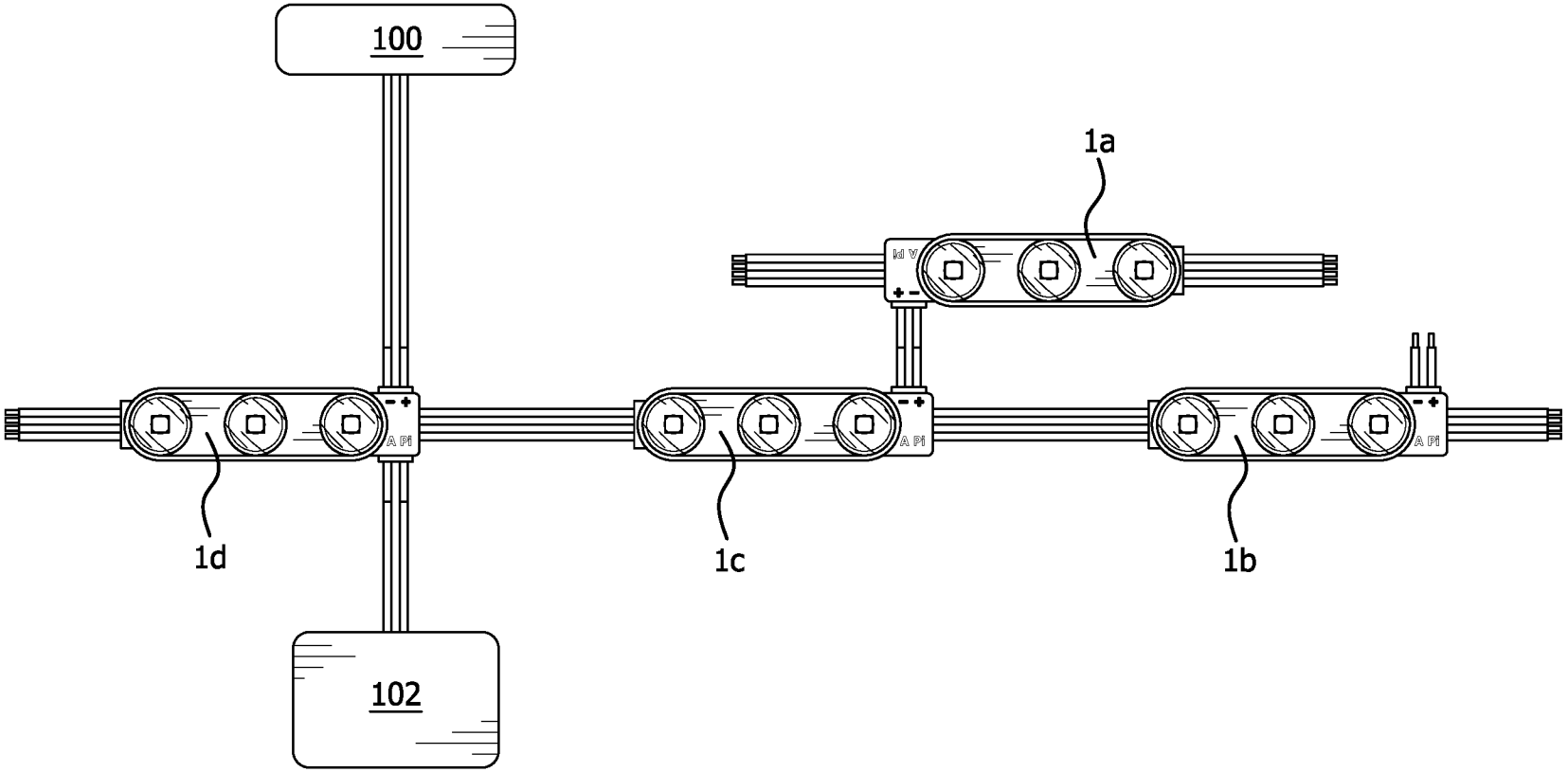
FIG. 4 illustrates the use of multiple LED lighting modules in a coordinated system.

As seen in FIG. 4, multiple modules 1*a*, 1*b*, 1*c* and 1*d* can be connected in one integrated system, thus allowing single power source 100 and a single data information data processor 102 to be utilized for the entire system having multiple modules.

Figure 5:
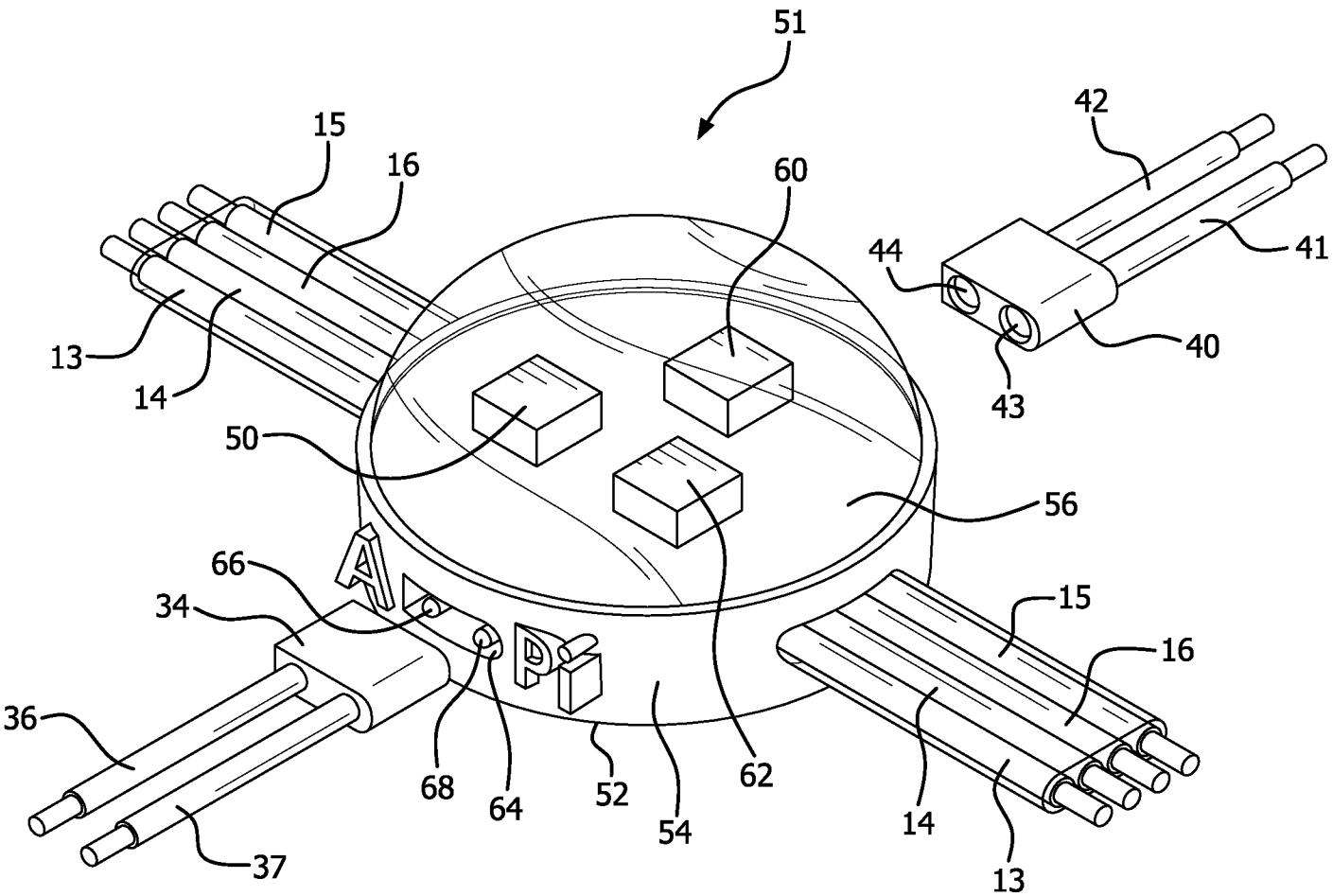
FIG. 5 is an alternate embodiment of the LED lighting module of the present invention.

FIG. 5 shows an alternate embodiment of the invention. LED lighting module 51 comprises main body section 52 with side surface 54 and top surface 56 on which LED lights 58, 60, and 62 are mounted. Informational data wiring 13 and 14 and electrical power wiring 15 and 16 extend to, through, and out module 51, via side surface 54. Internal cavity 64 through sidewall 54 has outwardly extending prongs 66 and 68 identical to the conductive prongs previously described with regard to module 1. Female connector 34 with informational data wiring 36 and 37 is configured to be inserted into cavity 64 for providing informational data to module 51, as previously described with referenced to module 1. By the same token, female connector 40 with electrical power wiring 41 and 42 and slotted openings 43 and 44 are configured to be inserted into the opposite facing cavity through sidewall 54 to establish electrical power to module 51, also as previously described with reference to module 1.

Figure 6:
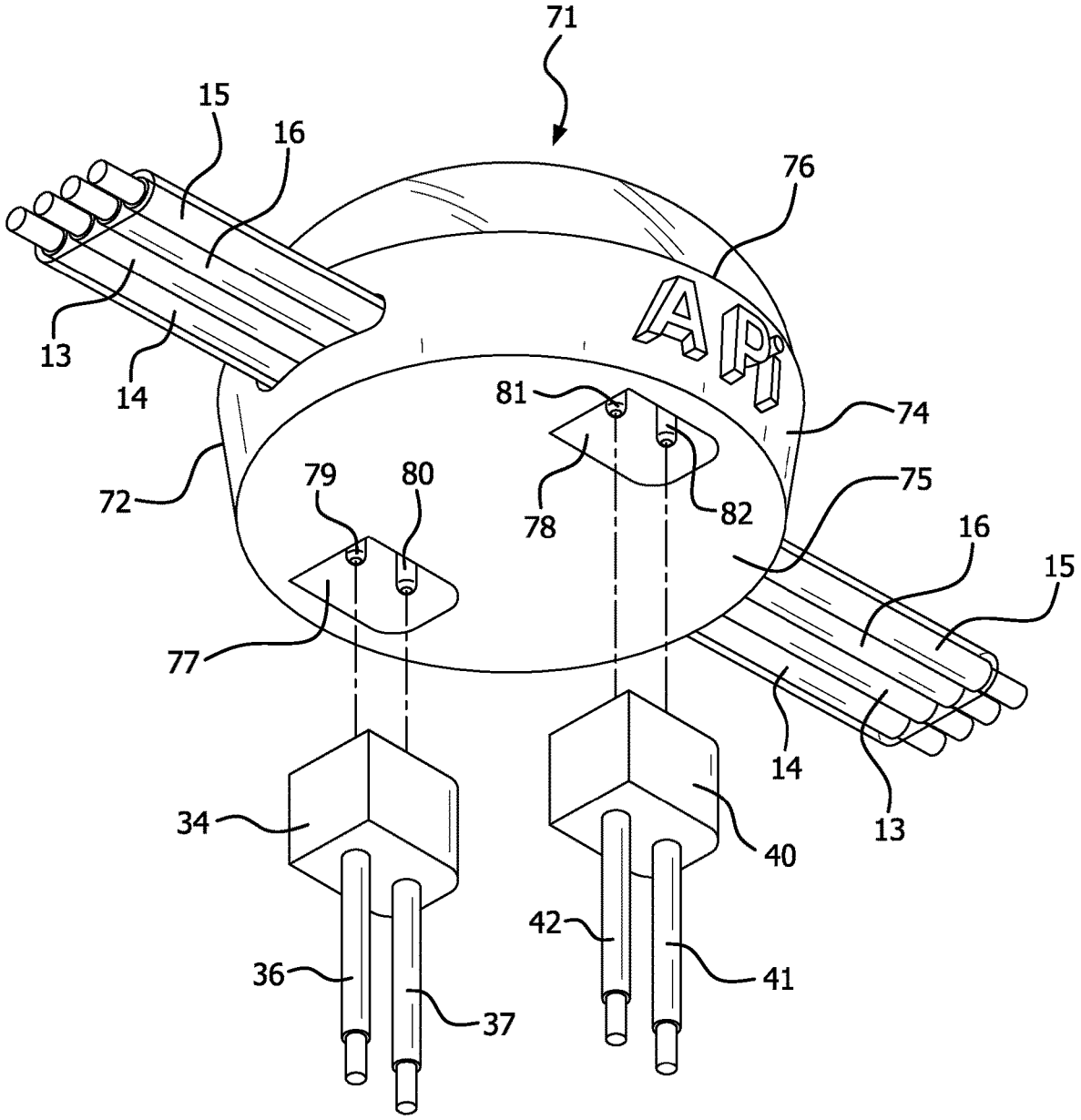
FIG. 6 is another alternate embodiment of the LED lighting module of the present invention.

FIG. 6 shows still another embodiment of the invention. LED lighting module 71 comprises main body section 72 with side surface 74, bottom surface 75, and top surface 76 on which LED lights are mounted. Informational data wiring 13 and 14 and electrical power wiring 15 and 16 extend to, through, and out module 71, via side surface 74. Internal cavities 77 and 78 are located through bottom surface 75. Outwardly extending prongs 79, 80, 81, and 82 identical to prongs 23, 24, 27 and 28 are connected to the wiring as previously described with regard to modules 1 and 51 and are configured to accept female connectors 34 and 40, also as described above.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An LED lighting module comprising:

a main body section on which LED lights are mounted and informational wiring data and electrical power wiring extending into, through, and out the module, said module further comprising a connectivity section at one of the ends of the main body, at least first and second cavities inset within the connectivity section, each cavity having a bottom wall and side walls, two conductive prongs located within each cavity positioned in spaced relation to the bottom walls and side walls, the two prongs in the first cavity being electrically connected within the confines of the connectivity section to the electrical power wiring and the two prongs in the second cavity being connected within the confines of the connectivity section to the informational data wiring, separate female connection members having informational data and electrical power wiring, said female members housing slotted openings, wherein the female member is configured to be inserted into the two cavities such that the prongs in the cavities are plugged into the slotted openings to provide informational data and establish electric power to the module.

2. The LED lighting module as in claim 1 wherein the main body is elongated and has two ends.

3. The LED lighting module as in claim 1 wherein the main body has a side surface and a bottom surface.

4. The LED lighting module as in claim 3 wherein the first and second cavities are located through the side surface of the connectivity section.

5. An LED lighting module system comprising:

at least two LED modules, each comprising a main body section on which LED lights are mounted, and informational data wiring and electrical power wiring extending into, through, and out the module, each said module further comprising a connectivity section at one of the ends of the main body, at least first and second cavities inset within the connectivity section, each cavity having a bottom wall and side walls, two conductive prongs located within each cavity positioned in spaced relation to the bottom walls and side walls, the two prongs in the first cavity being electrically connected within the confines of the connectivity section to the electrical power wiring and the two prongs in the second cavity being connected within the confines of the connectivity section to the informational data wiring; and separate female connectors housing slotted openings and having informational data and electrical power wiring, one of said female connectors having said electrical power wiring being configured to be inserted into the first cavity of each of said modules such that the prongs in the first cavities are plugged into the slotted openings of said female connectors to establish electrical power to the module and between said two modules, and the female connectors having said informational data wiring being configured to be inserted into the second cavity of each of said modules such that the prongs in the second cavities are plugged into the slotted openings of said female connectors to provide informational data to the module and between said two modules.

6. The LED lighting module system as in claim 5 wherein a single electrical power source and a single informational data processer provides the electrical power and the informational data to said at least two LED modules.

7. The LED lighting module as in claim 5 wherein the main body is elongated and has two ends.

8. The LED lighting module as in claim 5 wherein the main body has a side surface and a bottom surface.

9. The LED lighting module as in claim 8 wherein the first and second cavities are located through the side surface of the connectivity section.

* * * * *